US005823353A

United States Patent [19]

Perrin et al.

[11] Patent Number: 5,823,353

[45] Date of Patent: Oct. 20, 1998

[54] COMBINATION BUSINESS CARD CASE AND DISPLAY CASE

[75] Inventors: Patrick C. Perrin, Rancho Palos Verdes; Jimmie L. Whittington, deceased, late of Diamond Bar, both of Calif., by Eleanor Whittington, legal representative

[73] Assignee: Perrin Manufacturing Company, City of Industry, Calif.

[21] Appl. No.: 675,727

[22] Filed: Jul. 3, 1996

Related U.S. Application Data

[63] Continuation-in-part of Ser. No. 592,759, Jan. 26, 1996, abandoned.

[51] Int. Cl.[6] ..... B65D 85/672

[52] U.S. Cl. ..... 206/752; 206/387.1; 206/39.8

[58] Field of Search ..... 206/454, 736, 206/751–753, 387.1, 39, 39.8; 220/335, 337, 338

[56] References Cited

U.S. PATENT DOCUMENTS

| | | | |
|---|---|---|---|
| D. 338,336 | 8/1993 | Grant . | |
| D. 354,520 | 1/1995 | Pong . | |
| 390,984 | 10/1888 | Owen | 206/39 |
| 1,103,739 | 7/1914 | Cleveland . | |
| 1,989,159 | 1/1935 | Shiffman et al. . | |
| 4,505,404 | 3/1985 | Perchak et al. . | |
| 4,527,690 | 7/1985 | Schmidts et al. | 206/752 |
| 4,527,692 | 7/1985 | Neuman | 206/308.3 |
| 4,615,445 | 10/1986 | Stocchiero . | |
| 4,666,036 | 5/1987 | Bourbon . | |
| 4,676,375 | 6/1987 | Willems et al. . | |
| 4,836,376 | 6/1989 | Posso . | |
| 4,884,691 | 12/1989 | Behrens et al. | 206/425 |
| 4,886,166 | 12/1989 | Bankier et al. . | |
| 4,930,628 | 6/1990 | Bridges . | |
| 5,154,287 | 10/1992 | Morita | 206/387.1 |
| 5,429,237 | 7/1995 | Morita | 206/387.1 |
| 5,452,793 | 9/1995 | DiMeo, Jr., et al. . | |
| 5,518,116 | 5/1996 | Morita . | |

FOREIGN PATENT DOCUMENTS

| | | |
|---|---|---|
| 678168 | 8/1952 | United Kingdom . |

*Primary Examiner*—Paul T. Sewell
*Assistant Examiner*—Nhan T. Lam
*Attorney, Agent, or Firm*—The Law Firm of Sheldon & Mak

[57] ABSTRACT

This invention provides a transparent plastic business card holder 10 that can be converted to a desktop display case. There is provided a base member 16 having a back wall 18 and top, left and side walls 20, 22 and 24, respectively, to partially form a framed enclosure for the back wall 18. A front wall 26 equipped with a trough assembly 40 extends laterally across the face of the front wall 26 between the left and right side walls 42 and 44, respectively, of the trough assembly. The front wall member is hinged to the base member so that the base member can be rotated three-fourths of a full circle to expose the trough assembly 40 outside the base member to display the card members 12. In the closed position the front wall member 26 is latched to the back wall 18 by means of a latched device 14. The trough assembly is equipped with a lip member 54 that is slidably replaceable and on which may be imprinted informational indicia.

6 Claims, 3 Drawing Sheets

COMBINATION BUSINESS CARD CASE AND DISPLAY CASE

CROSS-REFERENCE

This application is a continuation-in-part of application Ser. No. 08/592,759 filed Jan. 26, 1996, now abandoned.

BACKGROUND

This invention is directed to a card member carrying case and more particularly to a multifunctional card member case that can easily be adapted to serve as a display case.

The use of calling cards or business cards are widely used in the everyday commercial world. One important function of the calling card is to personally provide the card to others so as to make known the card owner's business affiliation or representation to his prospective customers. This, of course, is for the purpose of promoting the goods and services they represent. Another important function of the card is to clearly display the card on the desk top making it readily accessible for visitors to retrieve, and again to make the card accessible to those who might be interested in picking it up independently of the card owner having to push the card. Accordingly, this provides certain business worthy information.

Another essential requirement of the card that gives it greater utility and functionality is its portability. Cards should be carried in a manner that protects them from being dog-eared or otherwise from being soiled. Business persons often attend public gatherings, both social and business in character, where the opportunity is presented to make known the business products and services they represent, as well as their own identity. The use of a case as an identification tag at such public gatherings greatly increases the utility and function of the business card.

SUMMARY

The instant invention provides a receptacle that can be carried on one's person for holding and displaying business cards, the receptacle being constructed of a base member formed with a back wall and enclosed on three sides with top, left and right side walls structures for partially framing the back wall structure. Said base member forming a partial enclosure for said card members. There is provided a front wall member having a front wall structure having an inside face and an outside face which is rotatably mounted on the base member.

The front wall member is adapted to be received within the enclosed base member in a manner that directs the inside face of the front wall towards the enclosure. The front wall member is equipped with a trough means on the inside face that is received inside the structure and into which is placed the supply of card members.

The trough means extends laterally across the inside face of the front wall. The trough with its supply of card members is captured and enclosed inside the structure. The front wall member is rotatably secured to the base member with appropriate hinge means so that the base member may be rotated to its display position exposing the trough means with its supply of card members. The display position is formed by rotating the base member approximately a full ¾ circle arc, thereby forming a base that supports the card members in a display condition. When the base member is open the front wall is prevented from further movement by coming to rest against a stop means positioned on at least one side wall of the base member adjacent the hinge means.

In its closed condition the base member captures the trough with its supply of card members so that they are securely contained.

Other embodiments of the invention provide for compressible, resilient tab means to be included for releasably holding the cards in place. Another embodiment provides for a flap means to be formed in the back wall which flap may be used to engage a portion of a person's garments providing an identification tag or name tag.

It is a primary object of this invention to enhance the utility of business cards or calling cards by providing a multifunctional carrying case.

It is another object of this invention to enhance the utility and functionality of business cards by providing a multifunctional carrying case that securely protects the cards so that they are printing press fresh.

It is still another object of this invention to provide a multifunctional carrying case for business cards that can be converted into a desk top display case or name tag. The following is a description of the drawings.

DRAWINGS

These and other features, aspects and advantages of the present invention will become better understood from the following description, appended claims, and accompanying drawings where:

DESCRIPTION

Figure 1:
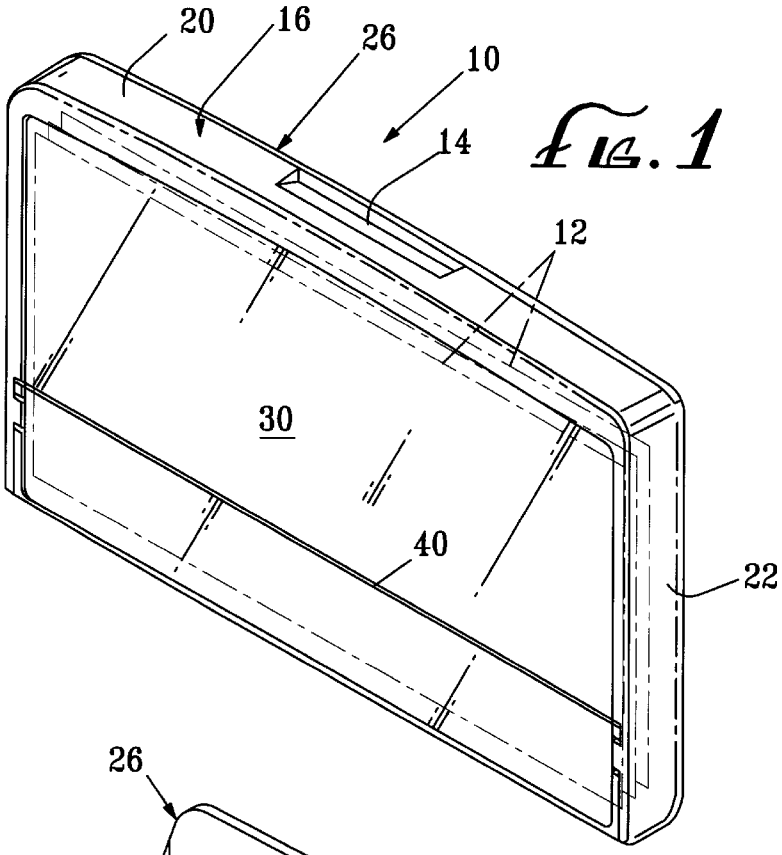
FIG. 1 is a perspective view of the combination card case and display case of this invention.
Figure 2:
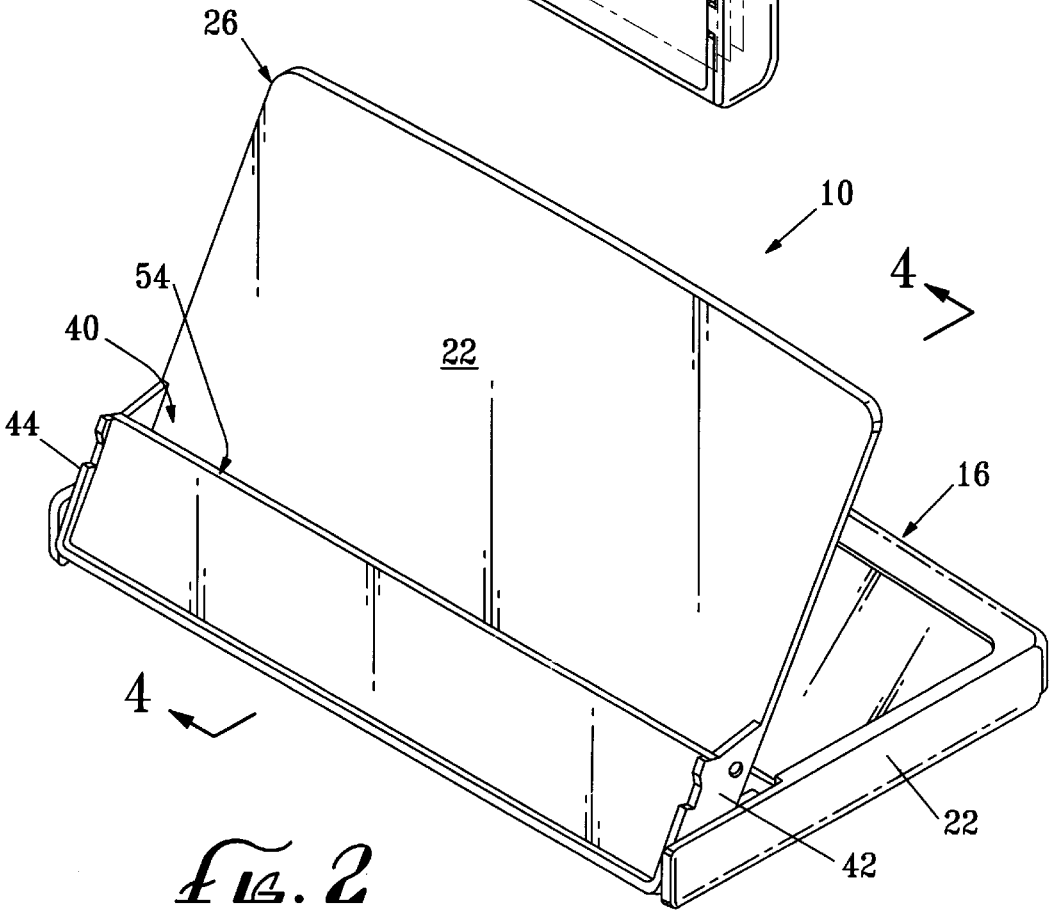
FIG. 2 is a perspective view of the card case in its open or display position.
Figure 3:
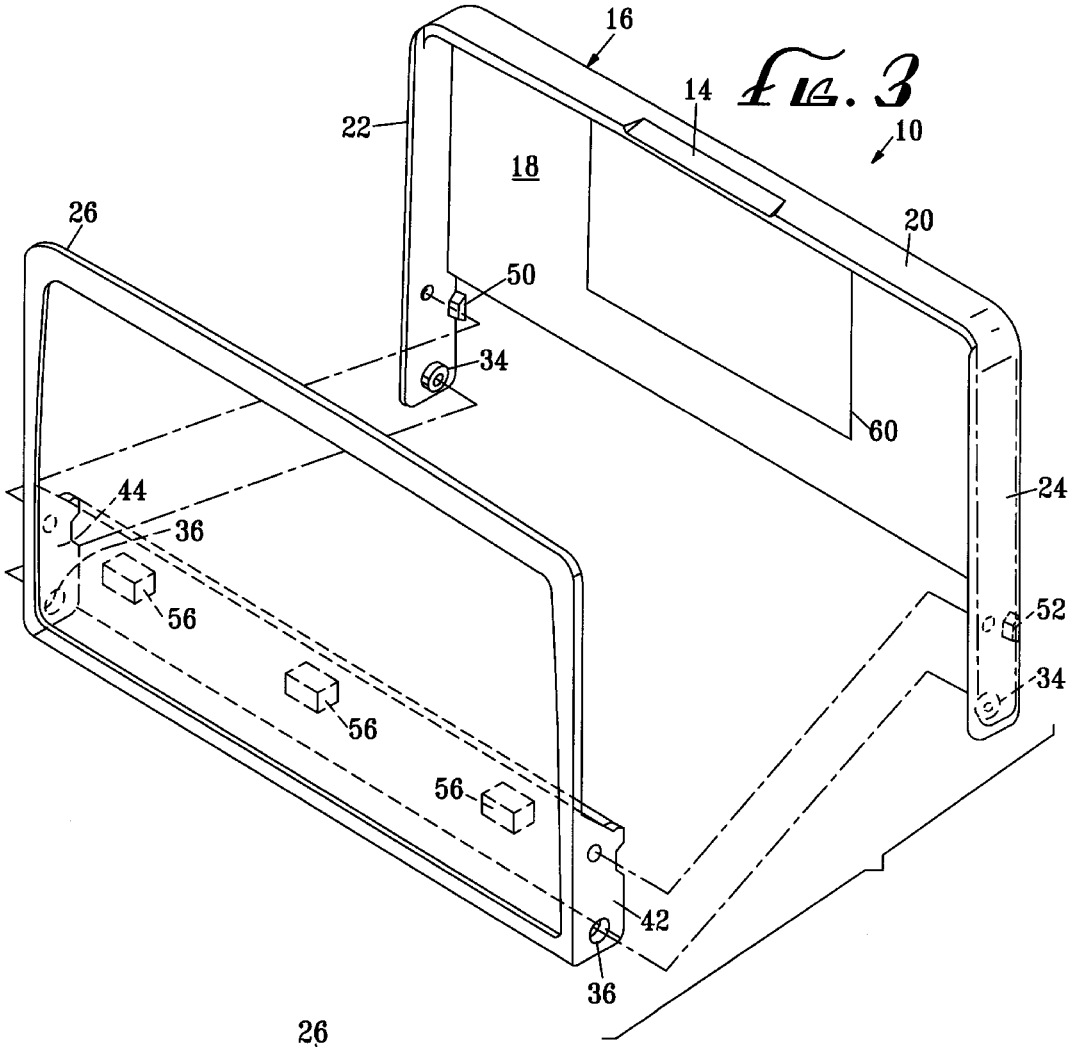
FIG. 3 is an exploded perspective of the card member case showing the hinged base member and the front wall trough assembly for holding a supply of cards.

As shown in the drawings for the purposes of illustration, the present invention is embodied in a receptacle for holding business cards that can function both as a card carrying case and also is readily converted to a business card display holder suitable for placement on one's desk top. As used herein the term card member is intended to cover any printed cards, such as the typical business calling card; photographic identification cards, such as a driver's license and credit cards. It will be appreciated that the display receptacle is not restricted to the dimensions of a card member and can be used to hold page size photographs, and documents in general. The combination shown in FIGS. 1 through 3 and FIG. 4 shows the structural details of how the convertability is effected. Referring to FIGS. 1 through 3, and as hereinafter more fully described, the instant card member case is identified generally as 10 shown in the closed position with a supply of business cards 12 contained within the case. Easy access to the supply of card members is accomplished by applying finger pressure on the latch mechanism 14 causing separation of the two members that comprise the combination case. More specifically, the base member 16 is structured so that it has a flat surfaced back wall 18 (FIG. 3) which is framed with a top wall structure 20, left and right wall structures 22 and. 24, respectively, thereby forming the base member 16. The second member is the front wall structure 26.

Figure 4:
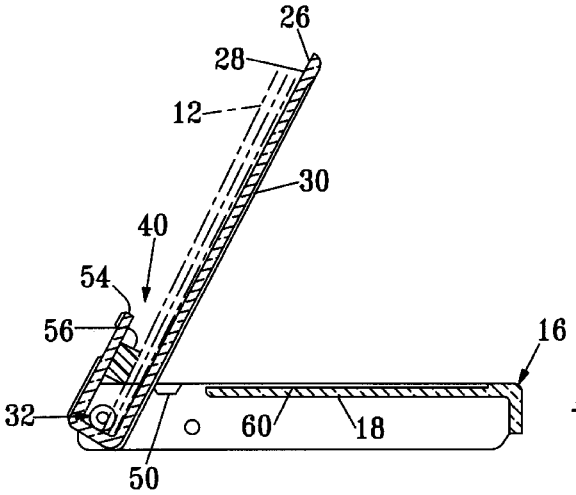
FIG. 4 is a cross section of FIG. 2 taken along line 4—4 running midway through the perspective of the card member case in its open condition.

It will be appreciated that the base member 16 serves as an enclosure for the cards when the base member 16 is in the closed position as shown in FIG. 1. When in the open position, as shown in FIG. 2, it functions as a display case. The novel and unique features of the instant invention can be more fully appreciated by referring to FIG. 2. The base member 16 is in its open position and thereby exposes the front wall member 26. The front wall member 26 comprises an inside face 28 and an outside face 30 (FIG. 4). As shown in FIG. 3, the front wall is hingedly mounted between the left and right wall 22 and 24, respectively, by the hinged mechanism 32 which is simply a stub rod 34 that is rotatively received in the hole 36 (FIGS. 3 and 4).

Turning now to the structure of the front wall 26, as it is illustrated in FIGS. 2 and 4, it includes a trough assembly 40 which extends laterally across the inside face 28 of the front wall 26 reaching between the left wall structure and right wall structures 22 and 24, respectively. At the lateral edge of the trough 40 are end walls 42 (FIG. 2) and 44. The left end wall 44 appears in phantom in FIG. 3. A supply of business cards can be deposited in the trough assembly 40 so that they can be securely stored when the case is closed and put on display when the base member is imparted a full ¾ circle arc being rotated away from the front wall.

The base member 16 at its left wall structure 22 and at its right wall structure 24 is provided with stub embossments 50 and 52, respectively, that serve as physical stops engaging the edge of the front wall thereby preventing its further movement once the base member is operated to its open position. It will be appreciated that the location of the stub embossments 50 and 52 can be manufactured so that they are uniformly located at different distances along the left and right side walls 22 and 24 which will change the visibility angle that the front wall forms with the base member. It should be understood that the embossments determine the angle that the front wall forms with the base member when the latter is rotated to its open position. It will be understood that the rotation movement of the base member at ¾ arc circle is not a critical requirement, only that said rotation opens the card holder to a sufficiently comfortable viewing angle for display such as, for example, on a desktop.

The receptacle of this invention lends itself to other subfeatures that enhance the utility of the case, both as a carrying case and as a display case.

Referring further to FIG. 4, the trough assembly 40 has a lip member 54 that generally restricts and contains the movement of card members deposited therein. In order to more rigorously retain the cards inside, the lip 54 may be fitted with a series of compressible, resilient tabs 56 that releasably engage a quantity of cards, holding them secure when the case is closed and also in the open and display positions. A quantity of cards will cause the tabs 56 to be compressed, thereby frictionally holding the cards in the trough, but in a very releasable condition by anyone seeking to retrieve a card.

Figure 5:
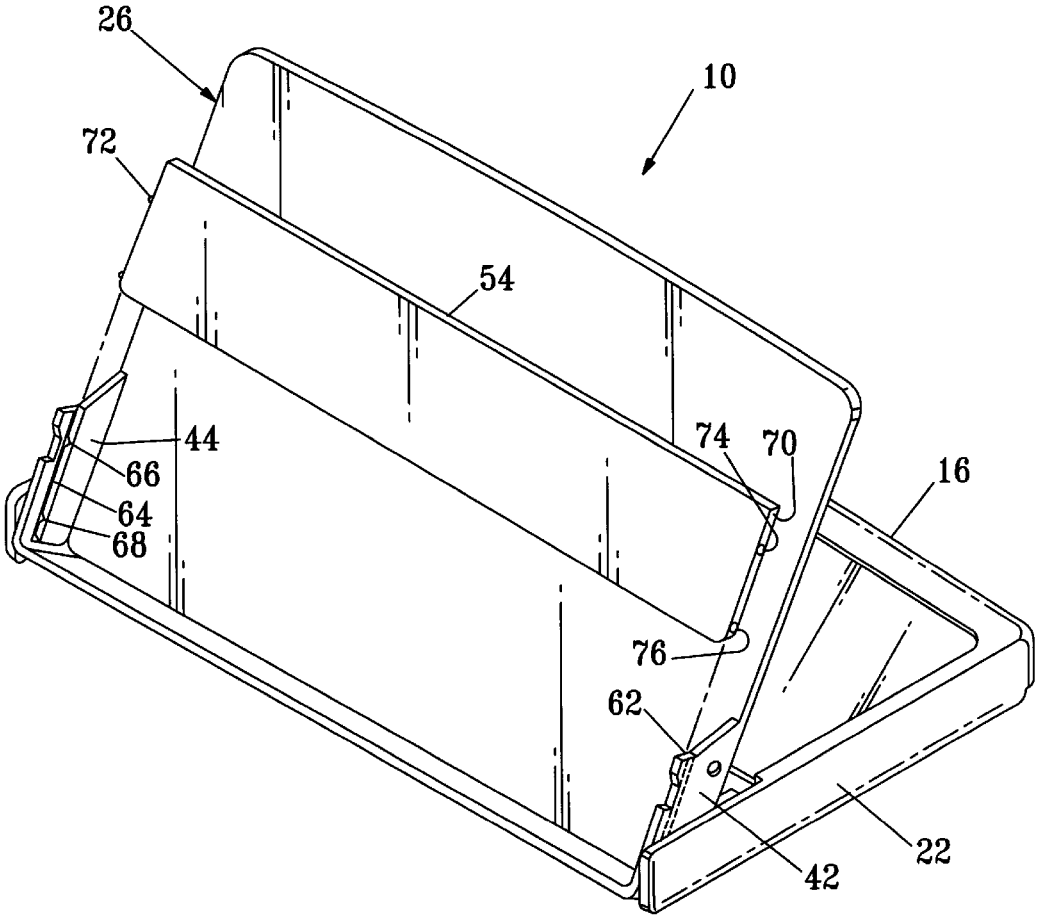
FIG. 5 is an enlarged detail of the card member cap illustrating the removability of a portion of the assembly.

Referring to FIG. 5, there is shown another preferred feature of the utility of the multifunctional card member case of this invention, the lip member 54. In another preferred embodiment it may be removably mounted between the side trough walls 42 and 44, permitting imprinting or embossing the plastic lip member 54 or applying a decorative treatment conveying identifying indicia or promotional information. As shown in FIG. 5, each of the trough side walls are formed with vertical extending grooved tracks 62 and 64 adapted to slidably receive the lip member 54. To secure the lip member 54 to the trough assembly 40, each of the tracks 62–64 include button elements 66 and 68 in the slide path of the lateral edges 70 and 72 of the lip member. The edges 70 and 72 are formed with detents 74 and 76 that fittingly engage the buttons elements thereby frictionally securing the lip member 54 within the tracks 62 and 64.

The use of a card case as an identification tag is another feature. Referring to FIG. 3, the back wall structure 18 may be modified by cutting a 3-sided section in the wall thereby forming a movable flap 60 that can be shifted outwardly from the plane of the wall 18 and employed to engage a person's pocket or the like so that the case serves as a name tag.

The card member case may be constructed of a wide range of plastic materials, such as polystyrene, polyvinyl chlorides, vinyl acetates, cellulose acetates, acrylic nitrites, and the like. It will be understood that the general use of the card member case requires that it be transparent so the contents can be read while while the cardholder is closed or it is opened for display. However, opaque materials may be used for parts of the case where visibility is not a requirement.

Although the present invention has been described in considerable detail with reference to certain preferred versions thereof, other versions are possible. Therefore, the spirit and scope of the appended claims should not be limited to the description of the preferred versions contained herein.

What is claimed is:

1. A receptacle for holding and displaying a card member suitable for being carried on one's person, said card member bearing informational data thereon, said receptacle comprising:

a base member having a back wall structure enclosed on three sides with top, left and right side wall structures for partially framing said back wall structure, forming a partial enclosure in which is stored a supply of said card members and operable between a closed position and an open position;

a front wall member having a front wall with free edges rotatably linked between the left and right side wall structures, said front wall having an inside face and an outside face and adapted to be received within the partially framed wall structure of the base member, said front wall equipped with a trough assembly extending laterally across the inside face of the front wall member and normal to said left and right side wall structures reaching between said side walls, said trough assembly being enclosed at its lateral ends with end wall portions, said trough assembly being adapted to removably contain at least one card member therein;

said back wall including flap means for insertion into a person's pocket, said flap means being flexibly secured to the back wall;

hinge means affixed to the inside of each one of the left and right side wall structures adjacent the trough assembly for rotatably linking said base member and said front wall member;

stop means associated with the base member adjacent the hinge means for engaging a free edge of the front wall to support the front wall when the base member is rotated to its display position to expose the trough assembly which is on the inside face of the front wall;

said receptacle being made of transparent plastic material;

whereby said front wall member when positioned within said framed structure forms an enclosure for the card member contained in the trough assembly and itself forms a display enclosure for the card member deposited in said trough assembly when said base member is rotated to its open display position.

2. The receptacle as claimed in claim 1 wherein the partially framed back wall is dimensioned leaving a clearance for the free movement of the front wall member into and out from the partially framed wall structure.

3. The receptacle as claimed in claim 1 including multiple compressible resilient tab elements on a inside lip of the trough assembly whereby said cards are releasably secured in said trough assembly.

4. The receptacle as claimed in claim 1 including latch means affixed to the top wall for engaging the top edge of the front wall thereby retaining said front wall within the partially framed structure of the base member and forming a closure for the card storage structure.

5. The receptacle as claimed in claim 1 wherein the display position is formed by rotating the base member in an arc in the range of about ¾ of a full circle.

6. A receptacle made of transparent plastic material for holding and displaying a card member suitable for being carried on a person's garment equipped with a pocket, said card member bearing informational data thereon, said receptacle comprising:

a base member having a back wall structure enclosed on three sides with top, left and right side wall structures for partially framing said back wall structure forming a partial enclosure in which is stored a supply of card members and operable between a display position and a closed position;

a front wall hingedly mounted within said base member, said front wall member equipped with a trough assembly to removably contain at least one card member therein, said trough assembly including a removable lip member slidably received therein and adapted to have information indicia imprinted thereon;

hinge means associated with said base member for rotatably linking said base member with said front wall member;

a flap means the back wall for insertion into the pocket of a person's garment to display the outside face of the front wall; and stop means affixed to the base member adjacent the hinge means for preventing further rotation of the front wall member beyond the display position when operated to said display position thereby exposing the trough assembly external of said base member.

* * * * *